US006361833B1

(12) United States Patent
Nakada et al.

(10) Patent No.: US 6,361,833 B1
(45) Date of Patent: Mar. 26, 2002

(54) COMPOSITION AND PROCESS FOR TREATING METAL SURFACES

(75) Inventors: Kazuya Nakada, Utsunomiya; Motoki Kawaguchi, Kawachi-gun, both of (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/830,736

(22) PCT Filed: Oct. 27, 1999

(86) PCT No.: PCT/US99/23982

§ 371 Date: Apr. 30, 2001

§ 102(e) Date: Apr. 30, 2001

(87) PCT Pub. No.: WO00/24948

PCT Pub. Date: May 4, 2000

(30) Foreign Application Priority Data

Oct. 28, 1998 (JP) ..... 10-307665
Oct. 16, 1999 (JP) ..... 11-291967

(51) Int. Cl.[7] ..... B05D 1/00; B05D 1/18; C23C 22/34; C23C 22/40; C09K 15/02; C22C 23/00; C22C 21/00

(52) U.S. Cl. ..... 427/436; 427/435; 252/389.52; 252/389.54; 252/392; 252/400.52; 252/400.54; 252/403; 148/437; 148/420; 148/441

(58) Field of Search ..... 252/389.52, 389.54, 252/392, 400.52, 400.54, 403; 427/435, 436; 148/437, 420, 441

(56) References Cited

U.S. PATENT DOCUMENTS

| | | | | |
|---|---|---|---|---|
| 2,438,877 A | | 3/1948 | Spruance, Jr. | 148/6.16 |
| 4,129,434 A | * | 12/1978 | Plumat et al. | 427/168 |
| 4,148,670 A | | 4/1979 | Kelly | 148/6.15 R |
| 5,397,390 A | | 3/1995 | Gorecki | 106/287.11 |
| 5,415,749 A | | 5/1995 | Hamilton | 204/181.6 |
| 5,667,845 A | | 9/1997 | Roberto et al. | 427/337 |
| 5,711,996 A | | 1/1998 | Claffey | 427/388.4 |
| 5,783,539 A | | 7/1998 | Angevaare et al. | 510/223 |
| 5,851,597 A | | 12/1998 | Kakizaki et al. | 427/435 |
| 5,859,165 A | | 1/1999 | Bossert et al. | 528/58 |
| 5,960,251 A | | 9/1999 | Brusic et al. | 428/551 |
| 6,020,034 A | | 2/2000 | Akki et al. | 427/475 |
| 6,136,381 A | | 10/2000 | Kakizaki et al. | 427/435 |

FOREIGN PATENT DOCUMENTS

| | | |
|---|---|---|
| JP | 52131937 | 11/1977 |
| JP | 09228062 | 9/1997 |

OTHER PUBLICATIONS

JP 57–041376 —03–08–82—esp@cenet database—12—IPC Classification: C23F7/00 (1982).
JP 56–136978—10–26 81—Questel Orbit Accession No. 1981–90170D[49]—Derwent Manual code: CPI: M14–D M14–K; Derwent Classes: M14 P42, (1981).
JP 032006994—01–31–91—(WPAT) AN—85–083496/14—XRAM C85–036278, (1991).
JP 01–104783—04–21–89—Questel Orbit Accession No.: 1989–162008[22]; Sec. Acc. No. CPI: C1989–072008—Derwent Manual code: CPI: M14–D01; Derwent Class: M14, (1989).

* cited by examiner

*Primary Examiner*—Joseph D. Anthony
(74) *Attorney, Agent, or Firm*—Wayne C. Jaeschke; Stephen D. Harper

(57) ABSTRACT

A composition and process for treating metal surfaces that contain at a weight ratio from 1:5,000 to 5,000:1 of at least one metal acetylacetonate selected from the group consisting of $Al(C_5H_7O_2)_3$, $V(C_5H_7O_2)_3$, $VO(C_5H_7O_2)_2$, $Zn(C_5H_7O_2)_2$, and $Zr(C_5H_7O_2)_4$, and at least one compound selected from water-soluble inorganic titanium compounds and water-soluble inorganic zirconium compounds, provides a non-chromate-type composition for imparting an excellent corrosion resistance and paint adherence to the surface of metals, particularly aluminum and its alloys, magnesium and its alloys and zinc and its alloys.

19 Claims, No Drawings

COMPOSITION AND PROCESS FOR TREATING METAL SURFACES

This application claims priority from Japanese patent applications JP H10-307665 filed Oct. 28, 1998 and JP H11-291967 filed Oct. 16, 1999, and International application PCT/US99/23982, filed Oct. 27, 1999.

FIELD OF THE INVENTION

This invention relates to a novel aqueous liquid composition, which is usually hereinafter called a "bath" for brevity, without any implication thereby that it must be used by immersion only, and to a process for treating a metal surface. The composition and process can provide the surfaces of various metals, especially aluminum, aluminum alloys, magnesium, magnesium alloys, and galvanized steel sheet, with an excellent corrosion resistance and excellent paint adherence.

The baths used to treat aluminum and aluminum alloy surfaces can be broadly classified into chromate-type baths and non-chromate-type baths. Chromic acid chromate conversion baths and phosphoric acid chromate conversion baths are typical examples of the chromate-type treatment baths.

Chromic acid chromate conversion baths first reached practical application in about 1950 and even now are widely used for the surface treatment of automotive heat exchangers, aluminum wheels, building materials, and aerospace materials. The main components in chromic acid chromate conversion baths are chromic acid and a fluoride reaction accelerator. This type of bath produces a conversion coating containing moderate amounts of hexavalent chromium on the metal surface.

Phosphoric acid chromate conversion baths originated with the invention disclosed in U.S. Pat. No. 2,438,877. The main components in phosphoric acid chromate conversion baths are chromic acid, phosphoric acid, and hydrofluoric acid. A conversion coating whose main component is hydrated chromium phosphate is formed by this type of bath on the metal surface. Since the resulting conversion coating does not contain hexavalent chromium, this type of bath is in wide use at the present time as an underpaint treatment for the body stock and lid stock of beverage cans.

While the conversion coatings generated by these chromate-type surface treatment baths exhibit an excellent corrosion resistance and an excellent adherence to paint films, these treatment baths also contain toxic hexavalent chromium, and the associated environmental problems have made it desirable to use treatment baths that are completely free of hexavalent chromium.

The treatment bath disclosed in Japanese Laid Open (Kokai or Unexamined) Patent Application Number Sho 52-131937 (131,937/1977) is an invention typical of the chromium-free non-chromate-type surface treatment baths. This surface treatment bath is an acidic (pH=approximately 1.5 to 4.0) aqueous coating solution that contains phosphate, fluoride, and zirconium or titanium or a mixture thereof. The treatment of metal surfaces with this surface treatment bath results in the formation on the metal surface of a conversion coating whose main component is an oxide of zirconium or titanium. This non-chromate-type surface treatment bath offers the advantage of not containing hexavalent chromium and for this reason is widely used at present for treating aluminum drawn-and-ironed, hereinafter usually abbreviated as "DI", can surfaces. Unfortunately, the coating produced by this non-chromate-type surface treatment bath is less corrosion resistant than chromate coatings.

The treatment method disclosed in Japanese Laid Open (Kokai or Unexamined) Patent Application Number Sho 57-41376 (41,376/1982) comprises treating the surface of aluminum, magnesium, or an alloy thereof with an aqueous solution containing at least one selection from titanium salts and zirconium salts, at least one selection from imidazole derivatives, and an oxidizer selected from nitric acid, hydrogen peroxide, and potassium permanganate. While the corrosion resistance of the coatings produced by this treatment bath would have been considered acceptable 15 years ago, this level of corrosion resistance is not unequivocally satisfactory at the present time.

Japanese Laid Open (Kokai or Unexamined) Patent Application Number Sho 56-136978 (136,978/1981) teaches a conversion bath that characteristically comprises an aqueous solution containing a vanadium compound and at least one compound selected from the group consisting of titanium salts, zirconium salts, and zinc salts. However, the conversion coating formed by this treatment bath cannot be expected to have a corrosion resistance better than or even as good as that of a chromate film in the case of challenge by long-term anticorrosion testing.

Thus, as described above, the use of the aforementioned prior-art non-chromate-type surface treatment baths remains associated with problems with the corrosion resistance of the produced conversion coatings. It is for this reason that at present non-chromate-type surface treatment baths are little used on surface treatment lines where a particularly good corrosion resistance is required, for example, for aluminum alloy heat exchangers and aluminiferous metal coil and sheet stock.

In summary, then, there has yet to be established a bath for treating aluminum and aluminum alloy surfaces that does not contain hexavalent chromium, that has an excellent effluent treatability, and that has the ability to form highly corrosion-resistant, highly paint-adherent conversion coatings.

For treating magnesium surfaces and magnesium alloy surfaces, chromate treatments as typified by JIS (Japanese Industrial Standard) H-8651 and MIL M-3171 are in use for treating magnesium and magnesium alloy surfaces. The conversion coatings generated by these chromate-type surface treatment baths exhibit an excellent corrosion resistance and an excellent adherence to paint films, but these treatment baths also contain highly toxic hexavalent chromium. The associated environmental problems have made it desirable to use treatment baths that are entirely free of hexavalent chromium.

The process disclosed in Japanese Patent Publication Number Hei 3-6994 (6,994/1991) is an invention typical of the chromium-tree non-chromate-type surface treatment baths for magnesium and its alloys. This treatment process comprises a phosphate treatment followed by a silicate treatment and then execution of a silicone treatment after the silicate treatment. The phosphate treatment coating by itself provides a low level of corrosion resistance and paint adherence when used as an underpaint treatment for magnesium and magnesium alloy surfaces. This treatment method also requires a multistage treatment process, uses high treatment temperatures, and requires long treatment times.

The known phosphate-based surface treatment methods for magnesium and its alloys include methods that employ treatment baths based on zinc phosphate, iron phosphate, calcium phosphate, or zirconium phosphate. However, these methods are not believed to have consistently provided a corrosion resistance that is satisfactory at a practical level.

A manganese phosphate treatment is disclosed in category 7 of JIS H-8651. This treatment bath is not acceptable from a practical standpoint because it contains chromium, requires high treatment temperatures of 80° C. to 90° C., and requires long treatment times of 30 to 60 minutes.

Another example of the non-chromate-type technology is found in Japanese Laid Open (Kokai or Unexamined) Patent Application Number Hei 9-228062 (228,062/1997), which teaches a surface treatment process that uses an aqueous solution that contains at least one organometal compound selected from metal alkoxides, metal acetylacetonates, and metal carboxylates and at least one film-formation stabilizer or film-formation auxiliary selected from acids, bases, their salts, and organic compounds containing the hydroxyl group, carboxyl group, or amino group. This aqueous solution is applied to magnesium stock at from 0 to 50° C. Again, however, the conversion coating formed by this treatment bath cannot be expected to have a corrosion resistance better than or even as good as that of a chromate film in the case of challenge by long-term anticorrosion testing.

Thus, as described above, the use of the aforementioned prior-art non-chromate-type surface treatment baths for magnesium and its alloys remains associated with problems with the corrosion resistance of the produced conversion coatings and with requiring treatment conditions unsuitable from a practical standpoint, i.e., high treatment temperatures, long treatment times, and high bath concentrations. It is for these reasons that at present non-chromate-type surface treatment baths are little used on surface treatment lines where a particularly good corrosion resistance and paint adherence are required, for example, for magnesium alloy automotive materials, aerospace materials, materials for electronic devices and instruments, and materials for communication devices and instruments.

In summary, then, there has yet to be established a bath for treating magnesium and magnesium alloy surfaces that does not contain hexavalent chromium, that has excellent process characteristics, and that has the ability to form highly corrosion-resistant, highly paint-adherent conversion coatings.

Chromate treatments and zinc phosphate treatments are the treatment processes generally applied to galvanized materials. The chromate treatments provide an excellent coating performance, but the corresponding treatment baths contain toxic chromium and hence raise issues with regard to the working environment and effluent discharge. The zinc phosphate treatments in some cases are unable to provide an acceptable corrosion resistance.

The non-chromate-type technologies for galvanized materials can be exemplified by the processes disclosed in the following patent documents: Japanese Laid Open (Kokai or Unexamined) Patent Application Number Hei 1-104783 (104,783/1989) discloses a process for producing surface-treated steel sheet. In this process, steel sheet plated with zinc, aluminum, or a zinc-aluminum alloy is coated with an alcohol solution containing at least one selection from the alkoxides and acetylacetonates of Si, Ti, Zr, Al, W, Ce, Sn, and Y. An oxide of the metal present in the solution is then formed on the surface of the steel sheet by heating to 200 to 500° C. after application of the bath. This preparative method suffers from issues with the working environment and energy costs, because it must use a flammable alcohol and requires fairly high temperatures for coating formation.

Thus, just as in the case of aluminum materials and magnesium materials, there has yet to be established a bath for treating the surfaces of galvanized materials that does not contain hexavalent chromium, that has excellent process characteristics, and that has the ability to form highly corrosion-resistant, highly paint-adherent conversion coatings.

The present invention is directed to solving the problems described above for the prior art. In more specific terms, a major object of the present invention is to provide a non-polluting composition and process for treating surfaces of at least one of aluminum and its alloys, magnesium and its alloys, and steel coated with zinc and its alloys that can impart thereto an excellent corrosion resistance and excellent paint adherence.

BRIEF SUMMARY OF THE INVENTION

It has been found that highly corrosion-resistant, highly paint-adherent conversion coatings can be formed on metal surfaces by the use of a special surface treatment composition that contains in suitable proportions at least one metal acetylacetonate selected from the group consisting of $Al(C_5H_7O_2)_3$, $V(C_5H_7O_2)_3$, $VO(C_5H_7O_2)_2$, $Zn(C_5H_7O_2)_2$, and $Zr(C_5H_7O_2)_4$, and at least one compound selected from water-soluble inorganic titanium compounds and water-soluble inorganic zirconium compounds.

DETAILED DESCRIPTION OF THE INVENTION AND PREFERRED EMBODIMENTS

A composition according to the present invention for treating metal surfaces comprises, preferably consists essentially of, or more preferably consists of, water and the following components:

(A) a component of at least one metal acetylacetonate selected from the group consisting of $Al(C_5H_7O_2)_3$, $V(C_5H_7O_2)_3$, $VO(C_5H_7O_2)_2$, $Zn(C_5H_7O_2)_2$, and $Zr(C_5H_7O_2)_4$; and (B) a component of at least one compound selected from water-soluble inorganic titanium compounds and water-soluble inorganic zirconium compounds, components (A) and (B) being present at a weight ratio of (A) to (B) that is from 1:5,000 to 5,000:1.

A bath according to the present invention for treating metal surfaces preferably, independently for each preference:

has a pH from 2.0 to 7.0;

contains from 0.01 to 50 grams of component (A) as described above per liter of bath, this unit of concentration being freely applied hereinafter to any constituent of the bath and being usually abbreviated as "g/l"; and contains from 0.01 to 50 g/l of component (B) as described above.

A process according to the present invention for treating metal surfaces preferably forms on said metal surface an organic-inorganic composite conversion coating at a coating weight of 5 to 2,000 milligrams of coating per square meter of the surface coated, this unit of coating weight being hereinafter usually abbreviated as "$mg/m^2$", by bringing the above-described bath for treating metal surfaces into contact with aluminum or an alloy thereof, magnesium or an alloy thereof, or zinc or an alloy thereof.

An important feature of the present invention is the formation of an organic-inorganic composite coating. It is believed that the corrosion resistance of the resulting conversion coating in particular is improved through the formation of this organic-inorganic composite coating.

The water-soluble inorganic titanium compound and/or water-soluble inorganic zirconium compound, which is an essential component in the surface treatment composition of the present invention, can be one or more selections, for example, from the sulfates, oxysulfates, nitrates, phosphates, chlorides, ammonium salts, and fluorides of titanium and zirconium. As long as this component is a water-soluble inorganic compound, its specific type is not critical. However, at least for economy, at least one of fluorotitanic and fluorozirconic acids and the salts of both of these acids are preferred. The water-soluble inorganic titanium and/or zirconium compound(s) are believed to precipitate on the surface of the metal workpiece as, for example, the oxide, phosphate, or fluoride of Ti or Zr and thus to form a framework or skeletal element of the organic-inorganic composite coating that is produced with the simultaneously precipitating metal acetylacetonate. Moreover, the presence of the Ti and/or Zr also improves the barrier performance (interception capability) of the coating with respect to corrosive environments and as a result makes possible the formation of a coating that has a corrosion resistance and paint adherence superior to the use of only the metal acetylacetonate.

The metal acetylacetonate : water-soluble inorganic compound concentration ratio preferably is at least, with increasing preference in the order given, 1.00:100, 1.00:50, 1.00:10, 1.00:7.0, 1.00:5.0, 1.00:3.0, 1.00:2.0, or 1.00:1.40 and independently preferably is not more than, with increasing preference in the order given, 400:1.00, 100:1.00, 10:1.00, 7.0:1.00, 5.0:1.00, or 2.5:1.00. The organic-inorganic composite coating formed when this weight ratio is below 1:5000 will have a poor corrosion resistance, while production of the organic-inorganic composite coating itself becomes difficult at above 5000:1.

A bath according to the present invention for treating metal surfaces essentially employs water and the hereinabove described surface treatment composition. This bath contains the metal acetylacetonate preferably at from 0.01 to 50 g/l and more preferably at from 0.1, or still more preferably, 1.0, to 20 g/l. While a conversion coating will be formed at a metal acetylacetonate content below 0.01 g/l, such a coating will usually have a poor corrosion resistance and paint adherence. Good quality conversion coatings are still formed at above 50 g/l, but since no additional increment in performance is obtained above 50 g/l, such concentrations are uneconomical due to the additional cost of the bath.

The content of water-soluble inorganic titanium compound(s) and/or water-soluble inorganic zirconium compound(s) is preferably from 0.01 to 50 g/l and more preferably from 0.05, or still more preferably 0.5, to 10 g/l. While a conversion coating will be formed at a content below 0.01 g/l, such a coating will usually have a poor corrosion resistance. Good quality conversion coatings are still formed at above 50 g/l, but since no additional improvement in performance is obtained above 50 g/l, such concentrations are uneconomical due to the additional cost of the bath.

The pH of a surface treatment bath according to the present invention must be within the range from 2.0 to 7.0 and preferably is within the range from 3.0 to 6.0. A pH below 2.0 hinders precipitation of the metal acetylacetonate on the metal surface and can cause irregularities or unevenness in appearance due to excessive etching of the metal surface. Formation of a highly corrosion-resistant conversion coating is strongly impaired at a pH above 7.0, and a pH above 7.0 can also cause problems with bath stability due to a pronounced tendency for the metal ions present in the bath to form a precipitate at such pH values. As necessary, the pH of the surface treatment bath of the present invention can be adjusted into the desiredrange through the use of an acid such as nitric acid, sulfuric acid, phosphoric acid, hydrofluoric acid, or fluorosilicic acid, or a base such as sodium hydroxide, sodium carbonate, potassium hydroxide, or ammonium hydroxide.

The stability of the treatment bath can be strongly impaired during execution of the surface treatment of the present invention by elution into the bath of metal ions, e.g., aluminum, magnesium, or zinc ions, from the metal workpiece. In such cases, an organic acid or alkali metal salt thereof may be added to the bath as a sequestering agent in order to chelate the metal ions. Organic acids used for this purpose can be exemplified by gluconic acid, heptogluconic acid, oxalic acid, tartaric acid, organophosphonic acids, and ethylenediaminetetraacetic acid.

An oxidizing agent can also be used in order to accelerate formation of the conversion coating of the present invention. This oxidizing agent can be exemplified by hydrogen peroxide, tungstic acid and its salts, molybdic acid and its salts, permanganic acid and its salts, and water-soluble organoperoxides such as tert-butyl hydroperoxide ($(CH_3)_3C—O—OH$).

The mass per unit area, usually called "coating weight", of the organic-inorganic composite conversion coating formed by the hereinabove described process is preferably from 5 to 2,000 mg/m$^2$ and more preferably is from 50, or still more preferably 140, to 500 mg/m$^2$. The corrosion resistance and paint adherence may be inadequate at a coating weight below 5 mg/m$^2$. While an excellent corrosion resistance is obtained at coating weights above 2,000 mg/m$^2$, no additional increment in performance is obtained above 2,000 mg/m$^2$ and such coating weights are therefore uneconomical due to the additional cost. Coating weights above 2,000 mg/m$^2$ are also undesirable because they can cause a conspicuous unevenness in coating appearance and tend to impair the paint adherence.

In regards to the metal components (Al, V, Zn, Zr, Ti) that may constitute the conversion coating, their chemical characteristics in the coating itself, for example, their bonding status, oxidation state, extent of polymerization or increase in molecular weight, and the like, are not critical.

Highly corrosion-resistant, highly paint-adherent conversion coatings can be formed by bringing the surface treatment bath of the invention into contact with aluminum or an alloy thereof, magnesium or an alloy thereof, or zinc or an alloy thereof. This process for treating the surface of various types of metals will be explained in greater detail in the following.

The surface treatment bath of the invention is used in a preferred embodiment as part of the following process operations:

(1) Surface cleaning/degreasing (this can be acidic, neutral, alkaline, or solvent cleaning/degreasing)

(2) Water rinse (3) Surface treatment using the surface treatment bath of the present invention (4) Water rinse (5) Deionized water rinse (6) Drying.

The surface treatment bath of the present invention is preferably brought into contact with the metal surface for 1 to 600 seconds at 10, or more preferably 35, to 80° C. The reactivity between the treatment bath and metal surface usually will be inadequate at contact temperatures below 10° C., and inadequate reactivity will prevent the formation of good quality conversion coatings. A conversion coating is still formed at contact temperatures above 80° C., but the correspondingly increased energy costs create undesirable economics for such temperatures. The extent of reaction will usually be inadequate at a treatment time below 1 second, preventing the formation of a highly corrosion-resistant conversion coating. At the other end of this range, no additional improvements are seen in the corrosion resistance and paint adherence of the conversion coating at times in excess of 600 seconds. Contact with the surface treatment bath of the invention can be effected by any means that achieves the required contact, with dipping or spraying being most commonly used.

A surface treatment composition bath according to the invention can be advantageously applied to pure aluminum and aluminum alloys that contain at least 50% by weight of aluminum. The applicable aluminum alloys encompass both multicomponent alloys, e.g., Al—Cu, Al—Mn, Al—Si, Al—Mg, Al—Mg—Si, and Al—Zn—Mg, and metals on which Al plating or Al alloy plating has been executed, for example, Al-plated steel sheet.

The surface treatment composition and bath according to the invention can also be advantageously applied to pure magnesium and magnesium alloys that contain at least 50% by weight of magnesium. Applicable magnesium alloys encompass multi-component alloys such as Mg—Al—Zn, Mg—Zn, and Mg—Al—Zn—Mn, and the magnesium or alloys can be plated on other metals.

Zinc and zinc alloys to which the invention can be advantageously applied include in particular metals on which Zn plating has been executed, including hot-dip zinc-plated steel sheet, galvannealed hot-dip zinc-plated steel sheet, Al/Zn alloy-plated steel sheet (Galfan™ and Galvalume™), electrogalvanized steel sheet, and alloy electrogalvanized steel sheet.

Such factors as the shape and dimensions of the metallic substrate to which the invention is applied are not critical, and, for example, the invention encompasses the treatment of sheet stock and various types of moldings. The surface of the workpiece may be in any condition as long as a metal as described above is present at least at a portion of the surface. For example, the surface can be cold rolled or plated as such, or can have been subjected to a treatment such as shot blasting, roughening with acid or alkali, or activation.

The effects of the composition, bath, and process of the invention are illustrated more specifically below through working and comparative examples.

EXAMPLES 1 TO 5

Comparative Examples 1 to 4

The following sample substrate materials were used in these examples:

Al—Mn alloy sheets according to Japanese Industrial Standard ("JIS") 3004, with dimensions of 150 millimeters (hereinafter usually abbreviated as "mm")×70 mm×0.2 mm thick;

Die-cast sheets with dimensions of 150 mm×100 mm×1 mm thick of AZ91D magnesium alloy as specified by JIS H2222; and Galvannealed hot-dip zinc-plated steel sheets with dimensions of 150 mm×70 mm×0.8 mm thick.

Process Conditions

The surface-treated samples were prepared by treatment according to the following operations in the sequence (1)→(2)→(3)→(4)→(5)→(6).

(1) Degreasing (43° C., 2 minutes, dipping), using an aqueous solution of 2% FINECLEANER® L4460A and 1.2% FINECLEANER® L4460B (both commercial products of Nihon Parkerizing Co., Ltd.).

(2) Tap water rinse (ambient temperature, 30 seconds, spray).

(3) Surface treatment (dipping) as detailed in the tables below.

(4) Tap water rinse (ambient temperature, 30 seconds, spray).

(5) Deionized water rinse (ambient temperature, 30 seconds, spray).

(6) Drying (80° C. for 3 minutes in a forced convection oven).

("Ambient temperature" means temperature as normally maintained in buildings for human comfort, i.e., about 18–23° C.)

The metal acetylacetonates used are listed below in Table 1, the water-soluble titanium compounds used are listed below in Table 2, the water-soluble zirconium compounds used are listed below in Table 3, and the reagents used to adjust the pH of the surface treatment baths are listed below in Table 4, in each instance together with the identifying symbols used for them in later tables.

TABLE 1

| Acetylacetonate Source Name and Chemical Formula | Identifying Symbol |
|---|---|
| Aluminum acetylacetonate $Al(C_5H_7O_2)_3$ | a |
| Vanadium acetylacetonate $V(C_5H_7O_2)_3$ | b |
| Vanadyl acetylacetonate $VO(C_5H_7O_2)_2$ | c |
| Zinc acetylacetonate $Zn(C_5H_7O_2)_2$ | d |
| Zirconium acetylacetonate $Zr(C_5H_7O_2)_4$ | e |

TABLE 2

| Titanium Source Name and Chemical Formula | Identifying Symbol |
|---|---|
| 40% Solution in water of fluorotitanic acid $H_2TiF_6$ | A |
| 20% Solution in water of titanium sulfate $Ti(SO_4)_2$ | B |

TABLE 3

| Zirconium Source Name and Chemical Formula | Identifying Symbol |
|---|---|
| 20% Solution in water of fluorozirconic acid $H_2ZrF_6$ | a |
| Ammonium fluorozirconate $(NR_4)_2ZrF_6$ | b |

TABLE 4

| pH Adjustment Agent Name and Chemical Formula | Identifying Symbol |
|---|---|
| 67.5% Solution of nitric acid in water $HNO_3$ | a |
| 40% Solution of fluorosilicic acid in water $H_2SiF_6$ | b |
| 25% Solution in water of ammonia $NH_4OH$ | c |

Surface treatment was performed using the treatment conditions and surface treatment bath compositions reported in Tables 5 and 6. The amounts of the reagents reported in the treatment bath composition columns in Tables 5 and 6 are values calculated for the pure reagent. The surface treatment conditions used in Comparative Examples 5 to 9 are reported further below.

Comparative Example 1 used a metal acetylacetonate as the only component of the treatment bath in order to provide a comparative example testing the formation of a coating of the metal acetylacetonate alone. Comparative Example 2 used a water-soluble titanium compound as the only component of the treatment bath in order to provide a comparative example testing the formation of a coating of the inorganic titanium compound alone. Comparative Example 3 employed a treatment bath comprising both the water-soluble inorganic titanium compound and the water-soluble inorganic zirconium compound in order to provide a comparative example testing the formation of an inorganic composite coating constituted of titanium and zirconium but lacking the metal acetylacetonate. Comparative Example 4 was directed to the formation of coatings with very low coating weights.

In Comparative Example 5, a 2% solution in water of a commercial zirconium phosphate surface treatment agent (ALODINE® 4040 from Nihon Parkerizing Co., Ltd.) was used to carry out surface treatment. This solution was applied to the above-described Al alloy sheet by spraying for 60 seconds at 50° C., after which the corrosion resistance and paint adherence were evaluated.

In Comparative Example 6, an aqueous solution of a commercial phosphoric acid chromate surface treatment agent (mixed aqueous solution of 4% of ALCHROM® K702SL and 0.3% of ALCHROM® K702AC, both from Nihon Parkerizing Co., Ltd.) was used to carry out surface treatment. This solution was applied to the above-described Al alloy sheet by spraying for 20 seconds at 50° C., after which the corrosion resistance and paint adherence were evaluated.

TABLE 5

Part A

| Example Number | Active Ingredients and Their Concentrations in g/l in the Surface Treatment Bath for This Example: Metal Acetylacetonate | | Titanium Source | | Zirconium Source | | pH Adjustment Agent | Treatment Conditions: pH | Temperature, ° C. | Contact Time, Seconds |
|---|---|---|---|---|---|---|---|---|---|---|
| 1 | e | 1.2 | A | 0.5 | None | None | None | 3.0 | 60 | 120 |
| 2 | b | 0.1 | None | None | a | 1.5 | c | 5.8 | 35 | 300 |
| | c | 1.0 | | | | | | | | |
| 3 | d | 20.0 | B | 10.0 | b | 1.0 | b | 2.7 | 70 | 3 |
| 4 | a | 1.0 | None | None | a | 3.0 | c | 4.6 | 50 | 90 |
| 5 | a | 0.5 | A | 1.0 | a | 1.0 | a | 3.8 | 70 | 60 |
| | d | 4.0 | | | | | | | | |

Part B

| Example Number | Substrate | Coating Weight, mg/m$^2$ | Salt Spray Corrosion Resistance Rating | Adherence, % of Grid Squares Remaining |
|---|---|---|---|---|
| 1 | Al alloy | 290 | ++ | 100 |
| | Mg alloy | 615 | ++ | 99 |
| | Zn plating | 190 | + | 100 |
| 2 | Al alloy | 400 | ++ | 100 |
| | Mg alloy | 1300 | ++ | 100 |
| | Zn plating | 360 | ++ | 99 |
| 3 | Al alloy | 185 | + | 100 |
| | Mg alloy | 680 | ++ | 98 |
| | Zn plating | 190 | + | 98 |
| 4 | Al alloy | 200 | + | 99 |
| | Mg alloy | 420 | ++ | 100 |
| | Zn plating | 140 | + | 98 |
| 5 | Al alloy | 780 | ++ | 100 |
| | Mg alloy | 1850 | ++ | 98 |
| | Zn plating | 1120 | ++ | 99 |

TABLE 6

Part A

| Comparative Example Number | Active Ingredients and Their Concentrations in g/l in the Surface Treatment Bath for This Comparative Example: Metal Acetylacetonate | | Titanium Source | | Zirconium Source | | pH Adjustment Agent | Treatment Conditions: pH | Temperature, ° C. | Contact Time, Seconds |
|---|---|---|---|---|---|---|---|---|---|---|
| 1 | a | 1.0 | None | None | None | None | b and c | 4.6 | 50 | 90 |
| 2 | None | None | A | 5.0 | None | None | c | 3.0 | 40 | 30 |
| 3 | None | None | A | 1.0 | a | 1.0 | c | 3.8 | 70 | 60 |
| 4 | e | 0.005 | A | 0.005 | None | None | c | 5.5 | 20 | 2 |
| 5 | None | None | None | None | None | None | None | * | 50 | 60 |
| 6 | None | None | None | None | None | None | None | * | 50 | 20 |
| 7 | None | None | None | None | None | None | None | * | 40 | 60 |
| 8 | None | None | None | None | None | None | None | * | 95 | 1800 |
| 9 | None | None | None | None | None | None | None | * | 43 | 120 |

Part B

| Comparative Example Number | Substrate | Coating Weight, mg/m$^2$ | Salt Spray Corrosion Resistance Rating | Adherence, % of Grid Squares Remaining |
|---|---|---|---|---|
| 1 | Al alloy | 175 | x | 98 |
| | Mg alloy | 350 | Δ | 98 |
| | Zn plating | 110 | x | 98 |
| 2 | Al alloy | 185 | x | 96 |
| | Mg alloy | 240 | x | 94 |

TABLE 6-continued

| | | | | |
|---|---|---|---|---|
| | Zn plating | 120 | x | 91 |
| 3 | Al alloy | 400 | Δ | 96 |
| | Mg alloy | 630 | Δ | 95 |
| | Zn plating | 190 | x | 90 |
| 4 | Al alloy | 1 | x | 72 |
| | Mg alloy | 2 | x | 85 |
| | Zn plating | 1 | x | 79 |
| 5 | Al alloy | 100 | x | 100 |
| 6 | Al alloy | Cr: 70 | + | 100 |
| 7 | Al alloy | Cr: 170 | ++ | 99 |
| | Mg alloy | Cr: 50 | + | 99 |
| | Zn plating | Cr: 70 | ++ | 100 |
| 8 | Mg alloy | Cr: 800 | ++ | 100 |
| 9 | Zn plating | 4000 | x | 91 |

*The pH value for these baths was not reported.

In Comparative Example 7, a 7% solution in water of a commercial chromic acid chromate surface treatment agent (ALCHROM® 713M from Nihon Parkerizing Co., Ltd.) was used to carry out surface treatment. This solution was applied to the above-described Al alloy sheet, Mg alloy sheet, and Zn-plated steel sheet by dipping for 60 seconds at 40° C., after which the corrosion resistance and paint adherence were evaluated.

In Comparative Example 8, a treatment bath based on MIL-M-3171C (TYPE III, with a main component of sodium bichromate) was used for surface treatment. This bath was applied to the Mg alloy sheet by dipping for 30 minutes at 95° C., after which the corrosion resistance and paint adherence were evaluated.

In Comparative Example 9, after degreasing (1) and water rinsing (2) the workpiece was dipped for 30 seconds at 25° C. in a 0.1% aqueous solution of a commercial titanium-based surface conditioner (PREPALENE® 4040 from Nihon Parkerizing Co., Ltd.). This was followed by surface treatment with an aqueous solution of a commercial zinc phosphate-based surface treatment agent (mixed aqueous solution of 5% of PALBOND® L3020, 0.5% of Additive 4813, 2% of Additive 4856, and 1% of Neutralizer 4055, all from Nihon Parkerizing Co., Ltd.). This bath was applied to the Zn-plated steel sheet by dipping for 120 seconds at 43° C., after which the corrosion resistance and paint adherence were evaluated.

Evaluation Methods (1) Coating Weight: The coating weight of the entire organic-inorganic composite coating was measured using either a fluorescence x-ray analyzer or stripping by dipping for 5 minutes at 90° C. in 5 weight % aqueous chromic acid solution.

(2) Corrosion Resistance: The corrosion resistance was evaluated using the salt spray test described in JIS Z-2371. The extent of corrosion development on the surface-treated sheet was evaluated visually after the salt spray test and reported on the following scale:

++=area of corrosion less than 10%;

+=area of corrosion at least 10%, but less than 30%;

Δ=area of corrosion at least 30%, but less than 50%;

×=area of corrosion at least 50%.

The salt spray times for each of the surface-treated samples were:

| | |
|---|---|
| For Al alloy sheet | 480 hours |
| For Mg alloy sheet | 24 hours |
| For Zn-plated steel sheet | 120 hours |

(3) Paint Adherence: Paint adherence testing was carried out on the Al alloy sheet, Mg alloy sheet, and Zn-plated steel sheet samples after surface treatment under the conditions of Examples 1 to 5 and Comparative Examples 1 to 9. The surface of the sample was coated to a dry film thickness of 10 micrometres (hereinafter usually abbreviated as "μm") with an epoxy resin paint from Kansai Paint Co., Ltd. and the sample was then baked for 10 minutes at 200° C. A grid of 100 squares (width=2 mm) was subsequently introduced in the center of the painted sheet using a cutter, after which the sample was dipped for 60 minutes in boiling deionized water. After this boiling water challenge, the painted sheet was air-dried and then subjected to a peeling test with cellophane tape. The paint adherence was evaluated on the basis of the number of grid squares that were not peeled off.

In this test, a larger number of remaining grid squares is indicative of a better paint adherence. A score of 98 or better indicates a satisfactory performance at the level of practical application.

The results of the evaluations are reported in Tables 5 and 6. These results demonstrate that the conversion coatings formed by the surface treatment baths of the present invention have a corrosion resistance and paint adherence equal to that of conventional chromate coatings. Moreover, the results in these tables demonstrate that an excellent corrosion resistance can be realized by the formation at appropriate coating weights of organic-inorganic composite coatings that contain both metal acetylacetonate and at least one of titanium and zirconium.

What is claimed is:

1. A process for forming a corrosion reducing coating over a surface selected from the group consisting of aluminum and alloys thereof, magnesium and alloys thereof, and zinc and alloys thereof by coating said surface with an aqueous liquid composition comprising water and the following components:

(A) a component of at least one metal acetylacetonate selected from the group consisting of $Al(C_5H_7O_2)_3$, $V(C_5H_7O_2)_3$, $VO(C_5H_7O_2)_2$, and $Zn(C_5H_7O_2)_2$;

(B) a component of at least one compound selected from water-soluble inorganic titanium compounds and water-soluble inorganic zirconium compounds, components (A) and (B) being present at a weight ratio of (A) to (B) that is from 1:5.000 to 5,000:1 to form a coating having a mass per unit area that is from 5 to 2,000 $mg/m^2$.

2. A process according to claim 1 wherein said surface is contacted with an aqueous liquid composition which has a pH value from 2.0 to 7.0; a concentration of component (A) that is from 0.01 to 50 g/l; a concentration of component (B) that is from 0.01 to 50 g/l; and a weight ratio of (A) to (B) is from 1,00:100 to 400:1.00.

3. A process according to claim 1 wherein said surface is contacted with an aqueous liquid composition which has a pH value from 3.0 to 6.0; a concentration of component (A) that is from 0.1 to 20 g/l; a concentration of component (B) that is from 0.05 to 10 g/l; and a weight ratio of (A) to (B) is from 1.00:10 to 10:1.00.

4. A process according to claim 1 wherein said surface is contacted with an aqueous liquid composition which has a pH value from 3.0 to 6.0; a concentration of component (A) that is from 1.0 to 20 g/l; a concentration of component (B) that is from 0.5 to 10 g/l; and a weight ratio of (A) to (B) is from 1.00:5.0 to 5.0:1.00.

5. A process according to claim 1 wherein said surface is contacted with an aqueous liquid composition which has a pH value from 3.0 to 6.0; a concentration of component (A) that is from 1.0 to 20 g/l; a concentration of component (B) that is from 0.5 to 10 g/l; and a weight ratio of (A) to (B) is from 1.00:5.0 to 5.0:1.00, and wherein component (B) is selected from the group consisting of fluorotitanic acid, fluorozirconic acid, and salts of both of these acids.

6. A process according to claim 1, wherein during said contacting said aqueous liquid composition is maintained at a temperature from 10 to 80° C. and contact is maintained for a time that is from 1 to 600 seconds.

7. A process according to claim 6, wherein during said contacting said aqueous liquid composition is maintained at a temperature of at least 35° C.

8. An aqueous liquid composition for treating a metal surface, said composition comprising water and the following components:

(A) a component of at least one metal acetylacetonate selected from the group consisting of $Al(C_5H_7O_2)_3$, $V(C_5H_7O_2)_3$, $VO(C_5H_7O_2)_2$, and $Zn(C_5H_7O_2)_2$, and (B) a component of at least one compound selected from water-soluble inorganic titanium compounds and water-soluble inorganic zirconium compounds, components (A) and (B) being present at a weight ratio of (A) to (B) that is from 1:5,000 to 5,000:1.

9. An aqueous liquid composition according to claim 8, additionally comprising at least one sequestering agent.

10. An aqueous liquid composition according to claim 9, wherein at least one sequestering agent is selected from the group consisting of organic acids and alkali metal salts thereof.

11. An aqueous liquid composition according to claim 8, additionally comprising at least one oxidizing agent.

12. An aqueous liquid composition according to claim 11, wherein at least one oxidizing agent is selected from the group consisting of hydrogen peroxide, tungstic acid, salts of tungstic acid, molybdic acid, salts of molybdic acid, permanganic acid, salts of permanganic acid, and water-soluble organoperoxides.

13. A aqueous liquid composition according to claim 8, wherein:

the composition has a pH value from 2.0 to 7.0;

there is a concentration of component (A) that is from 0.01 to 50 g/l;

there is a concentration of component (B) that is from 0.01 to 50 g/l; and the weight ratio of (A) to (B) is from 1.00:100 to 400:1.00.

14. A aqueous liquid composition according to claim 13, wherein:

the composition has a pH value from 3.0 to 6.0;

there is a concentration of component (A) that is from 0.1 to 20 g/l;

there is a concentration of component (B) that is from 0.05 to 10 g/l; and the weight ratio of (A) to (B) is from 1.00:10 to 10:1.00.

15. A aqueous liquid composition according to claim 14, wherein:

there is a concentration of component (A) that is from 1.0 to 20 g/l;

there is a concentration of component (B) that is from 0.5 to 10 g/l; and the weight ratio of (A) to (B) is from 1.00:5.00 to 5.00:1.00.

16. An aqueous liquid composition according to claim 15 wherein component (B) is selected from the group consisting of fluorotitanic acid, fluorozirconic acid, and salts of both of these acids.

17. An aqueous liquid composition for treating a metal surface, said composition having a pH value from 3.0 to 6.0 and comprising water and the following components:

(A) 1.0 to 20 g/l of a component of at least one metal acetylacetonate selected from the group consisting of $Al(C_5H_7O_2)_3$, $V(C_5H_7O_2)_3$, $VO(C_5H_7O_2)_2$, and $Zn(C_5H_7O_2)_2$ and (B) 0.5 to 10 g/l of a component of at least one water-soluble inorganic compound selected from the group consisting of titanium sulfates, titanium oxysulfates, titanium nitrates, titanium phosphates, titanium chlorides, ammonium salts of titanium, titanium fluorides, zirconium sulfates, zirconium oxysulfates, zirconium nitrates, zirconium phosphates, zirconium chlorides, ammonium salts of zirconium, and zirconium fluorides;

wherein the weight ratio of (A) to (B) is from 1.00:10.00 to 10.00:1.00.

18. A method of making an aqueous liquid composition for treating a metal surface, said method comprising:

(i) combining the following components in water to form a solution:

(A) a component of at least one metal acetylacetonate selected from the group consisting of $Al(C_5H_7O_2)_3$, $V(C_5H_7O_2)_3$, $VO(C_5H_7O_2)_2$, $Zn(C_5H_7O_2)_2$ and $Zr(C_5H_7O_2)_4$;

(B) a component of at least one compound selected from water-soluble inorganic titanium compounds and water-soluble inorganic zirconium compounds;

wherein components (A) and (B) are present at a weight ratio of (A) to (B) that is from 1:5,000 to 5,000:1; and (ii) adjusting the pH value of the solution to within the range from 2.0 to 7.0 using an acid or a base.

19. The method of claim 18 wherein the pH value of the solution is adjusted to within the range of 3.0 to 6.0.

* * * * *

UNITED STATES PATENT AND TRADEMARK OFFICE

CERTIFICATE OF CORRECTION

PATENT NO. : 6,361,833 B1
DATED : March 26, 2002
INVENTOR(S) : Nakada et al.

It is certified that error appears in the above-identified patent and that said Letters Patent is hereby corrected as shown below:

Title page,
Item [75], Inventors, insert therefor -- City -- after the word “Utsunomiya”.

Column 13,
Line 6, after the word “from” delete “1,00”; and insert therefor -- 1.00 --.

Signed and Sealed this

First Day of April, 2003

JAMES E. ROGAN
*Director of the United States Patent and Trademark Office*